US009764799B2

(12) United States Patent
Hooper

(10) Patent No.: US 9,764,799 B2
(45) Date of Patent: Sep. 19, 2017

(54) METHOD OF SUPPORTING A CHAIN STOPPER ON A VESSEL, A CHAIN STOPPER ASSEMBLY FOR A VESSEL, AND A VESSEL

(71) Applicant: PROMOR PTE LTD, Singapore (SG)

(72) Inventor: Alan Gregory Hooper, Singapore (SG)

(73) Assignee: PROMOR PTE LTD, Singapore (SG)

( * ) Notice: Subject to any disclaimer, the term of this patent is extended or adjusted under 35 U.S.C. 154(b) by 0 days.

(21) Appl. No.: 14/784,260

(22) PCT Filed: Jun. 27, 2014

(86) PCT No.: PCT/SG2014/000309
§ 371 (c)(1),
(2) Date: Oct. 13, 2015

(87) PCT Pub. No.: WO2015/199611
PCT Pub. Date: Dec. 30, 2015

(65) Prior Publication Data
US 2016/0137267 A1 May 19, 2016

(51) Int. Cl.
*B63B 21/18* (2006.01)
*B63B 22/02* (2006.01)
*B63B 21/04* (2006.01)
*B63B 21/50* (2006.01)

(52) U.S. Cl.
CPC ..... *B63B 21/50* (2013.01); *B63B 21/04* (2013.01); *B63B 21/18* (2013.01); *B63B 21/507* (2013.01)

(58) Field of Classification Search
CPC ..... B63B 21/50; B63B 21/507; B63B 21/18; B63B 21/04
See application file for complete search history.

(56) References Cited

U.S. PATENT DOCUMENTS 5,845,893 A * 12/1998 Groves ..... B63B 21/10 114/293
7,325,508 B2 2/2008 Boatman
7,510,452 B2 3/2009 Van Tol et al.
8,397,655 B2 3/2013 Braud et al.
2001/0029878 A1* 10/2001 Seaman ..... B63B 21/50 114/230.12

(Continued)

FOREIGN PATENT DOCUMENTS

EP 0399719 B1 2/1993
MX 2008008698 A 10/2008
RU 2010151971 A 6/2012

OTHER PUBLICATIONS

International Preliminary Report on Patentability mailed in corresponding International Patent Application No. PCT/SG2014/000309 on Dec. 24, 2014, consisting of 4 pp.

*Primary Examiner* — Anthony Wiest
(74) *Attorney, Agent, or Firm* — Volpe and Koenig, P.C.

(57) ABSTRACT

A method of supporting a chain stopper on a vessel, a chain stopper assembly for a vessel, and a vessel. The method of supporting a chain stopper on a vessel may comprise the steps of connecting a swivel element to the support structure on the vessel such that the swivel element is pivotable around a first axis perpendicular to a substantially horizontal axis; and coupling a chain stopper element to the swivel element such that the chain stopper element is pivotable relative to the swivel element around the substantially horizontal axis.

18 Claims, 6 Drawing Sheets

(56) References Cited

U.S. PATENT DOCUMENTS

| | | | | |
|---|---|---|---|---|
| 2005/0241558 | A1* | 11/2005 | Barlow | B63B 21/04<br>114/200 |
| 2010/0175604 | A1 | 7/2010 | Boatman et al. | |
| 2013/0199432 | A1 | 8/2013 | Askestad | |
| 2015/0090171 | A1* | 4/2015 | Dang | B63B 21/18<br>114/230.29 |
| 2016/0280333 | A1* | 9/2016 | Trouve | B63B 21/10 |

* cited by examiner

METHOD OF SUPPORTING A CHAIN STOPPER ON A VESSEL, A CHAIN STOPPER ASSEMBLY FOR A VESSEL, AND A VESSEL

FIELD OF INVENTION

The present invention relates broadly to a method of supporting a chain stopper on a vessel, a chain stopper assembly for a vessel, and to a vessel.

BACKGROUND

As the development of offshore fields move into deeper waters the requirements on the vessel mooring system become more challenging. In many areas a turret mooring system is used to moor the vessel at the offshore location.

The use of taut mooring line systems is becoming increasingly widespread for such offshore installations. In these mooring systems the mooring line is held under a tension which results in the line being fully suspended above the seabed. The mooring system relies on the elasticity in the mooring lines to accommodate vessel movements and loads rather than on the weight of the catenary in the suspended mooring lines. The mooring lines are thus loaded continuously in a dominant direction.

This results in the mooring lines approaching the vessel within a very limited range of approach angles at the mooring line chain stoppers. It also results in many small fluctuations in the mooring line angles resulting in fatigue stresses in the chains if typical single axis chain stoppers are used. These are typically referred to as out of plane bending stresses in the chain links.

To address this fatigue problem chain stopper assemblies with a trunnion block pivotally supported by the turret structure with a horizontal pivoting axis, and a chain stopper coupled to the trunnion block with a pivoting axis perpendicular to the horizontal have been proposed, for example in US 2010/0175604 and U.S. Pat. No. 7,325,508. Such chain stopper assemblies allow for movement to accommodate vessel offsets and vessel rolling motion. However, in such chain stopper assemblies the main movement of the chain stopper, which is typically the pivoting around the horizontal axis, acts on the horizontal pivoting axis via the coupling between the chain stopper and the trunnion block, resulting in un-desired loading of the coupling and possible failure of the coupling.

Embodiments of the present invention provide a method of supporting a chain stopper on a vessel, a chain stopper assembly for a vessel, and a vessel that seek to address at least one of the above problems.

SUMMARY

In accordance with a first aspect of the present invention there is provided a method of supporting a chain stopper on a vessel, the method comprising the steps of connecting a swivel element to the support structure on the vessel such that the swivel element is pivotable around a first axis perpendicular to a substantially horizontal axis; and coupling a chain stopper element to the swivel element such that the chain stopper element is pivotable relative to the swivel element around the substantially horizontal axis.

In accordance with a second aspect of the present invention there is provided a chain stopper assembly for a vessel comprising a support structure on the vessel; a swivel element connected to the support structure such that the swivel element is pivotable around a first axis perpendicular to a substantially horizontal axis; and a chain stopper element coupled to the swivel element such that the chain stopper element is pivotable relative to the swivel element around the substantially horizontal axis.

In accordance with a third aspect of the present invention there is provided a vessel comprising a chain stopper assembly as defined in the second aspect.

BRIEF DESCRIPTION OF THE DRAWINGS

Embodiments of the invention will be better understood and readily apparent to one of ordinary skill in the art from the following written description, by way of example only, and in conjunction with the drawings, in which.

DETAILED DESCRIPTION

Embodiments of the present invention relate to a method of supporting a chain stopper on a vessel, a chain stopper assembly for a vessel, and to a vessel.

Figure 1:
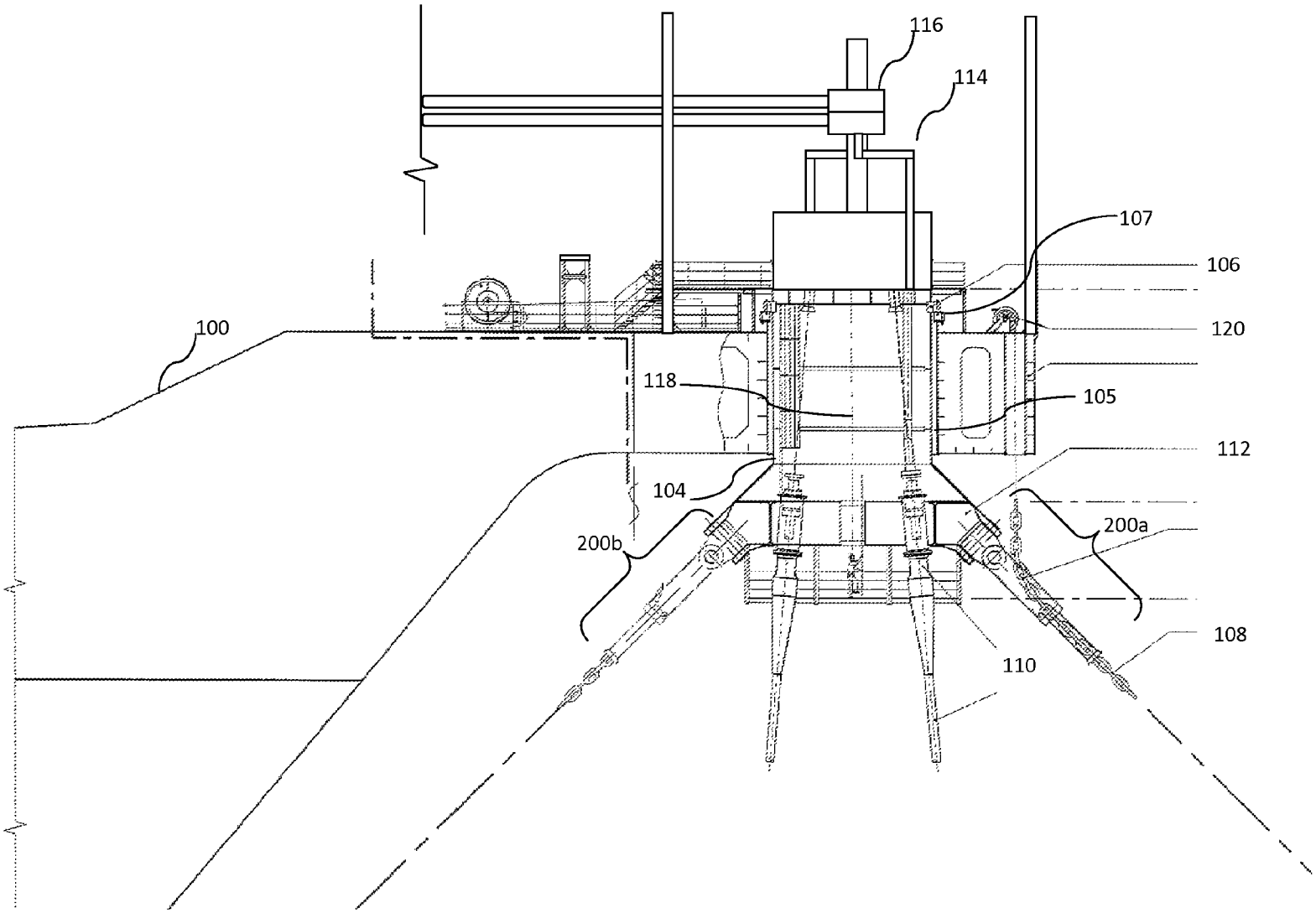
FIG. 1 shows a schematic diagram illustrating a partial view of a vessel according to an example embodiment.

FIG. 1 shows a schematic diagram illustrating a partial cross-sectional view of a vessel 100 according to an example embodiment. The vessel 100 comprises a cantilever turret in the form of a cylindrical shaft 104 fitted within a moonpool 105 at the bow of the vessel 100. A flange 106 of the shaft 104 is mounted on a turret bearing system 107 which is fixed to the deck at the bow of the vessel 100.

On the other, lower end of the shaft 104, a plurality of taut mooring lines e.g. 108 extend out from the shaft 104 to anchor the shaft 104 to the seabed. A plurality of production risers e.g. 110 runs from a wellhead (not shown) on the seabed to a mooring table 112 connected to the shaft 104. A piping system 114 connects the risers e.g. 110 to a fluid swivel assembly 116 for fluid communication with e.g. processing equipment or storage tanks (not shown) on the vessel 100.

This assembly allows the shaft 104 to be fixed to a position relative to the seabed, as well as allowing the vessel 100 to rotate about a substantially vertical axis 118 of the shaft 104 in a weather vane fashion under the prevailing environmental conditions. The fluid swivel assembly 116 allows fluid communication between the risers e.g. 110 and the processing equipment or storage tanks on the vessel 100 while the vessel 100 rotates. A mooring vertical sheave 120 is provided on the deck of the bow of the vessel 100 for initial installation of the mooring lines e.g. 108, as will be described below.

Figure 2:
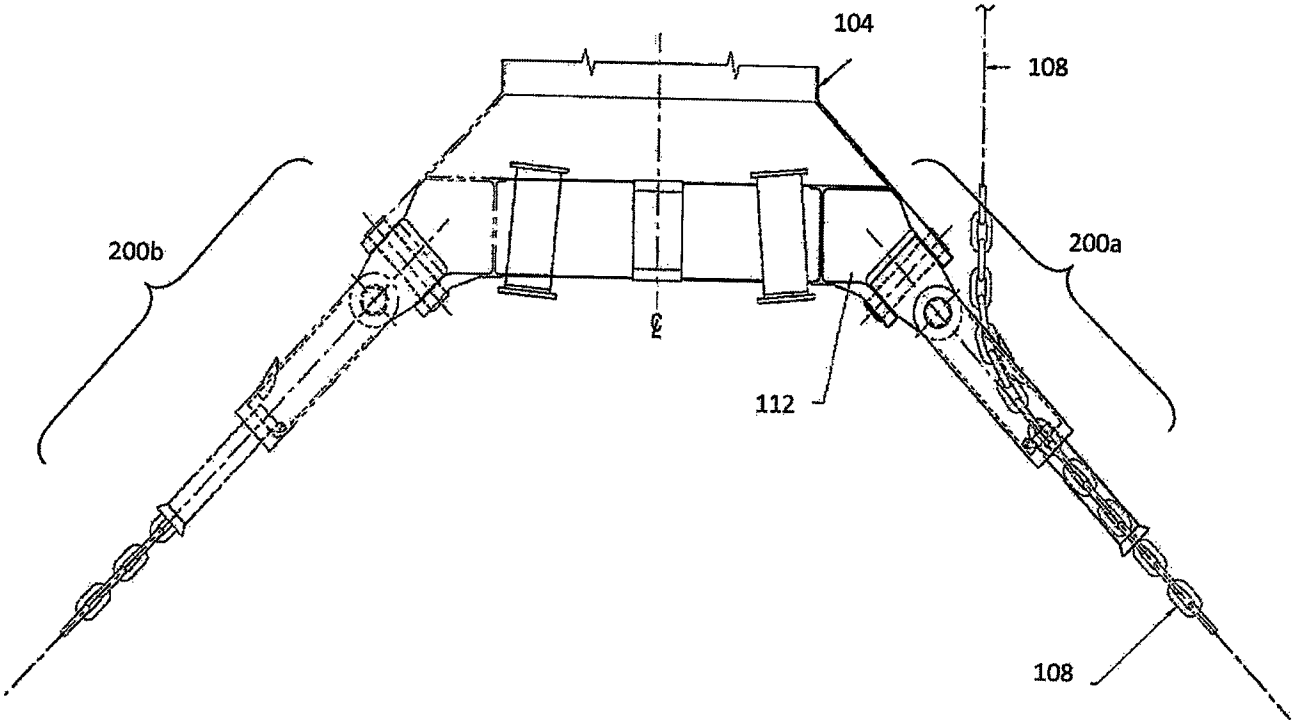
FIG. 2 shows a schematic drawing of a detail, partly in section, of the vessel of FIG. 1, illustrating chain stopper assemblies for a vessel according to an example embodiment.

FIG. 2 shows a detail of FIG. 1, in particular a cross-sectional view of the mooring table 112 connected to the shaft 104, with chain stopper assemblies, e.g. 200*a*, 200*b*.

Figure 3A:
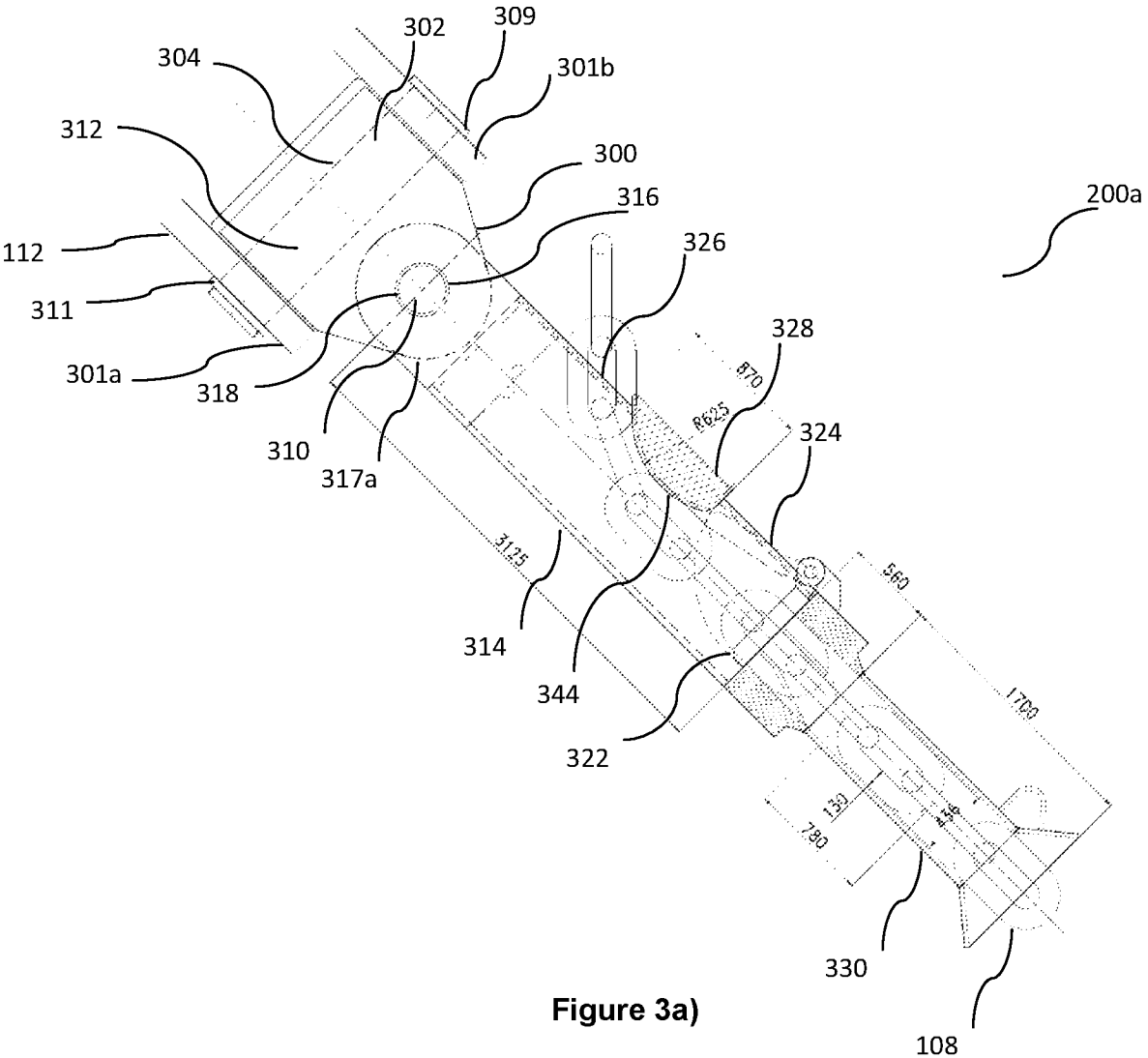
FIG. 3*a* shows a schematic drawing, partly in section, of a detail of the chain stopper assembly of FIG. 2, illustrating one chain stopper assembly for a vessel according to an example embodiment.

As is shown in FIG. 3*a*) in more detail, a swivel unit 300 is attached to the mooring table 112 by a swivel pin 302. In example embodiments, suitable fabricated or cast steel connections are used for the connection points 301*a*, 301*b* to the swivel unit 300 via the swivel pin 302 secured at the connection points 301*a, b*. In this embodiment, the pin 302 has a shoulder 309 at one end, for example located at the top end as illustrated in FIG. 3, to prevent it from slipping through the receiving opening after installation. There is a locking/stopper plate 311 installed on the bottom side to prevent the pin from sliding up during operation. In an alternative embodiment, the locking/stopper plate may be fitted at the top end, with the shoulder of the pin disposed at the bottom end, which may make inspection and installation of the locking/stopping plate easier. There are bearings e.g. 304 provided on the inside of one end of the swivel unit 300 to allow the swivel unit 300 to rotate around the swivel pin 302. The swivel pin 302 in this example embodiment is disposed at about 45° off-vertical.

The other end of the swivel unit 300 comprises an opening 310 disposed at a right angle to the swivel pin axis 312, providing a substantially horizontal pivoting axis. A chain stopper section 314 is attached to the swivel unit 300 by a chain stopper pin 316 which is inserted into the opening 310. Bearings e.g. 318 are also provided within the end of the swivel unit 300 to allow the chain stopper section 314 to rotate around the chain stopper pin 316. In this embodiment, the shortest distance of the opening 310 to the connection point 301*a* is the same as a shortest distance of the opening 310 to the connection point 301*b*. The chain stopper pin 316 is secured at opposing connection points, e.g. 317*a*, on the chain stopper section 314.

In an alternative embodiment, instead of having bearings e.g. 318 for chain stopper pin 316 in the swivel unit 300, bearings may be placed in the connection points e.g. 317*a* in the chain stopper section 314. This may reduce the cyclic variations in the bearing loads and can advantageously provide for a more uniform load distribution.

The swivel unit 300 with the two pin axes at right angles, i.e. swivel pin axis 312 and the substantially horizontal chain stopper pin axis, advantageously provides a dual axis movement capability.

Figure 3B:
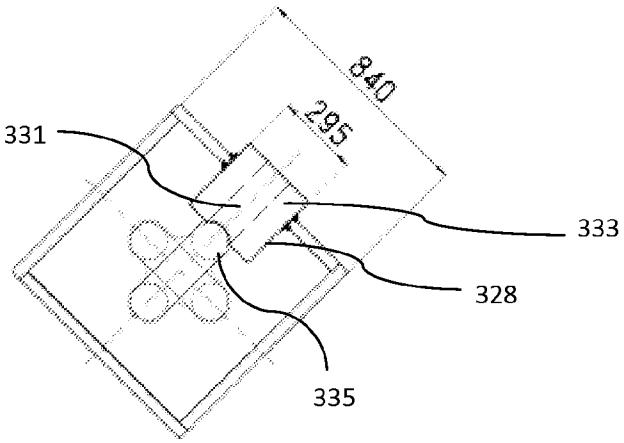
FIG. 3*b* shows a cross-sectional detail of FIG. 3*a*.

The chain stopper section 314 in this embodiment comprises a longitudinal structure, for example a square or rectangular fabricated structure, which includes a pivoting chain pawl 322 for locking the mooring line or chain 108 in place. On the upward facing side 324 of the chain stopper section 314 an opening 326 is provided in this embodiment, with a fixed guide shoe 328. A chain inlet guide 330 is provided at the distal end of the chain stopper section 314. As shown in FIG. 3*b*), the guide shoe 328 in this embodiment comprises a groove 331 extending along a curved surface 333 of the guide shoe 328, for guiding the every second chain link element, i.e. the link elements e.g. 335 disposed perpendicularly with respect to the surface 333.

Figure 3C:
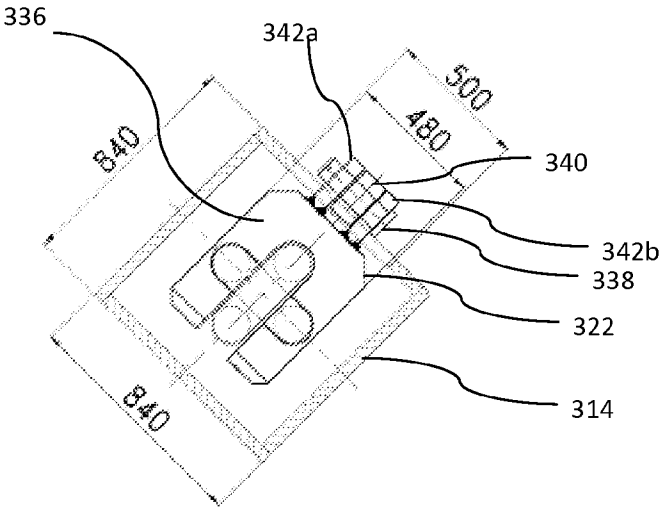
FIG. 3*c* shows another cross-sectional detail of FIG. 3*a*.

During initial installation of the mooring line or chain 108 in the chain stopper section 314, a winch wire (not shown) from the mooring vertical sheave 120 (FIG. 1) is first passed down vertically through the opening 326 and past the guide shoe 328 and the chain pawl 322. The chain pawl 322 is temporarily held open at this time. In this embodiment, the chain pawl 322 can be held open by another wire (not shown) attached to the top of the chain pawl 322 which is used to pivot the chain pawl 322 up and out of the way. The winch wire is connected to the chain 108 and the chain 108 pulled into the chain stopper section 314 until the chain pawl 322 is locked in place, upon release of tension in the wire attached to the top of the chain pawl 322 and the chain pawl 322 pivoting back into the locking position, for example under gravitational force alone. The winch wire is then dis-connected. As shown in FIG. 3*c*), in this embodiment the chain pawl 322 comprises a substantially U-shaped main body 336 pivotally connected to the chain stopper section 314 using a secured pin 338 received in corresponding openings in a connector 340 formed or fixed on the chain stopper section 314, and a pair of connector elements 342*a, b* formed or fixed on the main body 336 of the chain pawl 322.

Returning to FIG. 3*a*), preferably, the position of the opening 326 along the chain stopper section 314 is as close as possible to the swivel unit 300 to minimise/reduce the tendency of the chain stopper section 314 to lift up when the chain 108 is being pulled in. Since the winch wire or chain 108 is pulled around the guide shoe 328, there is a net reaction at an angle upwards. Advantageously, the chain 108 coming in across the bottom edge 344 of chain inlet guide 330 during installation of the mooring line or chain 108 also creates a force in the opposite direction, which counters the upward reaction at the guide shoe 328. In this embodiment, the opening 326 is disposed nearer to the swivel unit 300 than to the distal end of the chain stopper section 314.

It is noted that the dimensions indicated in FIG. 3*a*)-*c*) are non-limiting examples for illustration only and can vary in different embodiments according to requirements, as will be appreciated by a person skilled in the art.

In operation, as the vessel moves horizontally or rolls, the dual axis chain stopper assembly 200*a* follows the angle of the mooring line or chain 108 and thus preferably avoids excessive fatigue issues in the chain 108 which can lead to out of plane bending failures.

As shown in FIGS. 1 and 2, in the example embodiment a plurality of such chain stopper assemblies, e.g. 200*a*, 200*b*, are provided arranged around the shaft 104 to suit the mooring pattern used.

Figure 4:
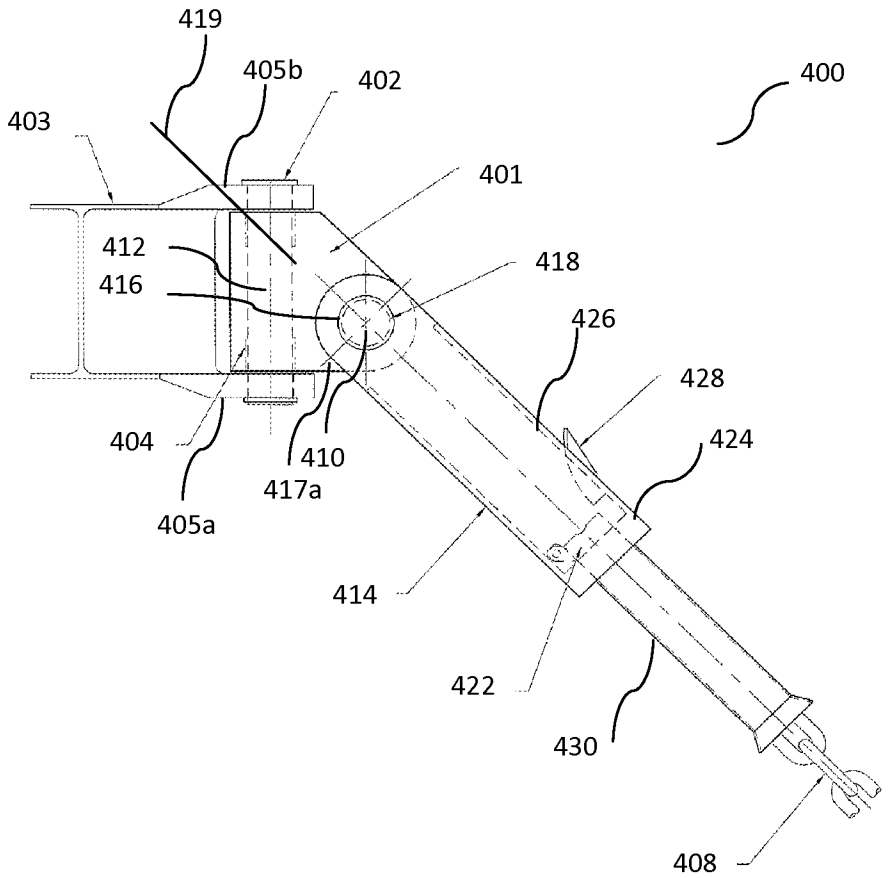
FIG. 4 shows a schematic drawing, partly in section, illustrating a chain stopper assembly for a vessel according to another example embodiment.

FIG. 4 shows a detail of a cross-sectional view of chain stopper assembly 400 according to another example embodiment. A swivel unit 401 is attached to a mooring table 403 by a swivel pin 402. In example embodiments, suitable fabricated or cast steel connections are used for the connection points 405*a*, 405*b* to the swivel unit 401 via the swivel pin 402 secured at the connection points 405*a, b*. There are bearings e.g. 404 provided on the inside of one end of the swivel unit 401 to allow the swivel unit 401 to rotate around the swivel pin 402. The swivel pin 402 in this example embodiment is disposed substantially vertically.

The other end of the swivel unit 401 comprises an opening 410 disposed at a right angle to the swivel pin axis 412, providing a substantially horizontal pivoting axis. A chain stopper section 414 is attached to the swivel unit 401 by a chain stopper pin 416 which is inserted into the opening 410. Bearings e.g. 418 are also provided within the swivel unit 401 to allow the chain stopper section 414 to rotate around the chain stopper pin 416. In this embodiment, the shortest distance of the opening 410 to the connection point 405*a* is shorter than a shortest distance of the opening 410 to the connection point 405*b*. This can be preferred to keep the line of action 419 of the tension in the mooring line, which is typically within a limited range of approach angles, within the top and bottom connection points 405*b* and *a*. This advantageously avoids the swivel unit 401 trying to rock on the swivel pin 402. The chain stopper pin 416 is secured at opposing connection points, e.g. 417*a*, on the chain stopper section 414.

In an alternative embodiment, instead of having bearings e.g. 418 for chain stopper pin 416 in the swivel unit 401, bearings may be placed in the connection points e.g. 417*a* in the chain stopper section 414. This may reduce the cyclic variations in the bearing loads and can advantageously provide for a more uniform load distribution.

The swivel unit 401 with the two pin axes at right angles, i.e. swivel pin axis 412 and the substantially horizontal chain stopper pin axis, advantageously provides a dual axis movement capability.

The chain stopper section 414 in this embodiment again comprises a longitudinal structure, for example a square or rectangular fabricated structure, which includes a pivoting chain pawl 422 for locking the mooring line or chain 408 in place. On the upward facing side 424 of the chain stopper section 414 an opening 426 is provided in this embodiment, with a fixed guide shoe 428. A chain inlet guide 430 is provided at the distal end of the chain stopper section 414.

In the example embodiment a plurality of such stopper assemblies 400 are provided arranged around the shaft (not shown) to suit the mooring pattern used.

Figure 5:
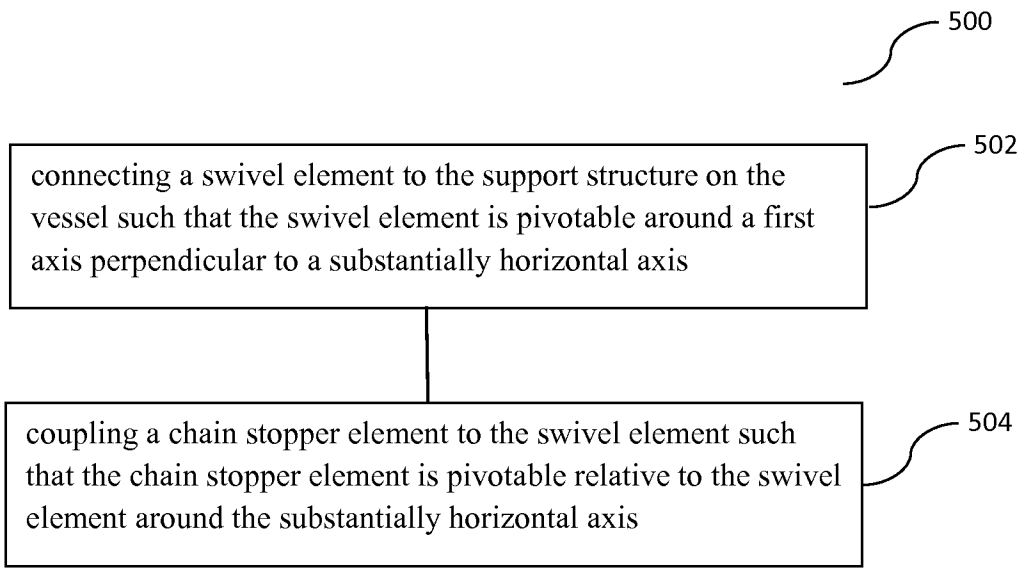
FIG. 5 shows a flowchart illustrating a method of supporting a chain stopper on a vessel, according to an example embodiment.

FIG. 5 shows a flowchart 500 illustrating a method of supporting a chain stopper on a vessel, according to one embodiment. At step 502 a swivel element is connected to the support structure on the vessel such that the swivel element is pivotable around a first axis perpendicular to a substantially horizontal axis. At step 504, a chain stopper element is coupled to the swivel element such that the chain stopper element is pivotable relative to the swivel element around the substantially horizontal axis.

The method may further comprise receiving a chain stopper pin in one or more bearings of the swivel element or of the chain stopper element for coupling the chain stopper element to the swivel element. The method may further comprise connecting the chain stopper pin at one or more connection points of the chain stopper element.

The method may further comprise receiving a swivel pin in one or more bearings of the swivel element for connecting the swivel element to the support structure. The method may further comprise connecting the swivel pin at one or more connection points of the support structure.

The swivel pin may be disposed off-vertically. The swivel pin may be disposed off-vertically in a range from about 30° to 60°. The swivel pin may be disposed about 45° off-vertically.

The swivel pin may be disposed substantially vertically. The method may further comprise disposing the swivel pin with a shortest distance to a lower connection point on the support structure which is smaller than a shortest distance to an upper connection point on the support structure.

The method may further comprise feeding a mooring line through a side opening in a hollow main body of the chain stopper element. The method may further comprise guiding the chain through the side opening using a guide shoe on the main body. The method may further comprise locking the mooring line using a pawl at a distal end of the main body. The method may comprise choosing a position of the side opening along the hollow main body for reducing lift up of the chain stopper element when a chain is being pulled in. The method may comprise disposing the side opening nearer to the swivel element than to the distal end of the hollow main body.

The support structure may be connected to a mooring table of the vessel. The mooring table may be connected to a turret shaft of the vessel.

In one embodiment, a chain stopper assembly for a vessel comprises a support structure on the vessel; a swivel element connected to the support structure such that the swivel element is pivotable around a first axis perpendicular to a substantially horizontal axis; and a chain stopper element coupled to the swivel element such that the chain stopper element is pivotable relative to the swivel element around the substantially horizontal axis.

The swivel element or the chain stopper element may comprise one or more bearings for receiving a chain stopper pin for coupling the chain stopper element to the swivel element. The chain stopper element may comprise one or more connection points for the chain stopper pin. The assembly may further comprise the chain stopper pin.

The swivel element may comprise one or more bearings for receiving a swivel pin for connecting the swivel element to the support structure. The support structure may comprise one or more connection points for the swivel pin. The assembly may further comprise the swivel pin.

The swivel pin may be disposed off-vertically. The swivel pin may be disposed off-vertically in a range from about 30° to 60°. The swivel pin may be disposed about 45° off-vertically.

The swivel pin may be disposed substantially vertically. The swivel pin may be disposed with a shortest distance to a lower connection point on the support structure which is smaller than a shortest distance to an upper connection point on the support structure.

The assembly may further comprise a side opening in a hollow main body of the chain stopper element for feeding a mooring line there through. The assembly may further comprise a guide shoe on the main body for guiding the chain through the side opening. The main body may comprise a pawl at a distal end thereof for locking the mooring line. The chain stopper element comprises a hollow guide body attached to the main body at the distal end thereof. A position of the side opening along the hollow main body may be chosen for reducing lift up of the chain stopper element when a chain is being pulled in. The side opening may be disposed nearer to the swivel element than to the distal end of the hollow main body.

The support structure may be connected to a mooring table of the vessel. The mooring table may be connected to a turret shaft of the vessel.

In one embodiment, a vessel comprises a chain stopper assembly as described above.

The construction and arrangement of the chain stopper assembly in the embodiments described advantageously allow for improved load transfer into the turret shaft structure. Preferably, the main movement of the chain stopper section, which is typically the pivoting around the horizontal axis, acts directly on the horizontal chain stopper pin which couples the chain stopper section to the swivel unit for improved load transfer into the turret shaft structure. The construction and arrangement of the chain stopper assembly in the embodiments described advantageously also allow for a more compact overall turret arrangement.

Suitable materials for use in example embodiments include, but are not limited to:

Swivel unit: Cast steel
Chain stopper section: Steel
Chain inlet guide: Steel
Guide shoe: Steel
Chain pawl: High strength cast steel Connection points: Structural cast steel Pins: High tensile forged steel.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive. Also, the invention includes any combination of features, in particular any combination of features in the patent claims, even if the feature or combination of features is not explicitly specified in the patent claims or the present embodiments.

The invention claimed is:

1. A method of supporting a chain stopper on a vessel, the method comprising the steps of:

connecting a swivel element to a rotatable mooring table connected to the vessel such that the swivel element is pivotable relative to the rotatable mooring table around a first axis perpendicular to a substantially horizontal axis; and coupling a chain stopper element to the swivel element such that the chain stopper element is pivotable relative to the swivel element around the substantially horizontal axis.

2. The method as claimed in claim 1, further comprising receiving a chain stopper pin in one or more bearings of the swivel element or of the chain stopper element for coupling the chain stopper element to the swivel element and connecting the chain stopper pin at one or more connection points of the chain stopper element.

3. The method as claimed in claim 1, further comprising receiving a swivel pin in one or more bearings of the swivel element for connecting the swivel element to the rotatable mooring table and connecting the swivel pin at one or more connection points of the rotatable mooring table.

4. The method as claimed in claim 3, wherein the swivel pin is disposed off-vertically.

5. The method as claimed in claim 3, wherein the swivel pin is disposed substantially vertically.

6. The method as claimed in claim 5, further comprising disposing the swivel pin with a shortest distance to a lower connection point on the rotatable mooring table which is smaller than a shortest distance to an upper connection point on the rotatable mooring table.

7. The method as claimed in claim 1, further comprising feeding a mooring line through a side opening in a hollow main body of the chain stopper element.

8. The method as claimed in claim 7, comprising choosing a position of the side opening along the hollow main body for reducing lift up of the chain stopper element when a chain is being pulled in.

9. The method as claimed in claim 8, comprising disposing the side opening nearer to the swivel element than to the distal end of the hollow main body.

10. A chain stopper assembly for a vessel comprising:

a rotatable mooring table for connection to the vessel;

a swivel element connected to the rotatable mooring table such that the swivel element is pivotable relative to the rotatable mooring table around a first axis perpendicular to a substantially horizontal axis; and a chain stopper element coupled to the swivel element such that the chain stopper element is pivotable relative to the swivel element around the substantially horizontal axis.

11. The assembly as claimed in claim 10, wherein the swivel element or the chain stopper element comprises one or more bearings for receiving a chain stopper pin for coupling the chain stopper element to the swivel element and wherein the chain stopper element comprises one or more connection points for the chain stopper pin.

12. The assembly as claimed in claim 10, wherein the swivel element comprises one or more bearings for receiving a swivel pin for connecting the swivel element to the rotatable mooring table and wherein the rotatable mooring table comprises one or more connection points for the swivel pin.

13. The assembly as claimed in claim 12, wherein the swivel pin is disposed substantially vertically.

14. The assembly as claimed in claim 13, wherein the swivel pin is disposed with a shortest distance to a lower connection point on the rotatable mooring table which is smaller than a shortest distance to an upper connection point on the rotatable mooring table.

15. The assembly as claimed in claim 10, further comprising a side opening in a hollow main body of the chain stopper element for feeding a mooring line there through.

16. The assembly as claimed in claim 15, wherein a position of the side opening along the hollow main body is chosen for reducing lift up of the chain stopper element when a chain is being pulled in.

17. The assembly as claimed in claim 16, wherein the side opening is disposed nearer to the swivel element than to the distal end of the hollow main body.

18. A vessel comprising:

a rotatable mooring table connected to the vessel;

a swivel element connected to the rotatable mooring table such that the swivel element is pivotable relative to the rotatable mooring table around a first axis perpendicular to a substantially horizontal axis; and a chain stopper element coupled to the swivel element such that the chain stopper element is pivotable relative to the swivel element around the substantially horizontal axis.

* * * * *